US006621019B1

(12) United States Patent
Narasimhan

(10) Patent No.: US 6,621,019 B1
(45) Date of Patent: Sep. 16, 2003

(54) GALLIUM WETTED CORE MEMBER AS AN ELECTRICAL TILT SWITCH ELEMENT

(75) Inventor: Dave Narasimhan, Flemington, NJ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/254,389

(22) Filed: Sep. 25, 2002

(51) Int. Cl.[7] ..... H01H 35/02

(52) U.S. Cl. ..... 200/61.47; 200/220

(58) Field of Search ..... 200/61.45 R–61.53, 200/182, 193, 194, 214–216, 220, 226, 231, 233–236

(56) References Cited

U.S. PATENT DOCUMENTS 6,313,417 B1 * 11/2001 Schnell ..... 200/61.47

* cited by examiner

*Primary Examiner*—Ramon M. Barrera

(57) ABSTRACT

An electrical switch comprising of a non-conducting hollow housing and a number of spaced electrodes, each of which extends through the housing, and a contact member within the cavity which comprises of a core member having a layer of liquid gallium or gallium alloy adhered to and surrounding the core member. The contact member is moveable within the housing in response to movement of the housing, and able to electrically connect any two electrodes by positioning the gallium or gallium alloy layer in contact with the electrodes, and to electrically disconnect the electrodes by positioning the gallium or gallium alloy layer out of contact with the electrodes.

20 Claims, 1 Drawing Sheet

GALLIUM WETTED CORE MEMBER AS AN ELECTRICAL TILT SWITCH ELEMENT

FIELD OF THE INVENTION

The invention is in the field of electrical switches, in particular, electrical switches relying on a liquid metal or metal alloy as an electrical conducting material for bridging an electrical gap between electrodes.

BACKGROUND OF THE INVENTION

Electrical switches and sensors that are usually referred to as "tilt" switches, such as thermostats, float controls, solenoids, relays, etc. are commonly used in a variety of electrical applications. The making or breaking of electrical contact in these switches, hence the electrical switching action, is generally accomplished by mechanical movement of the switch which causes a quantity of a bridging conducting material contained therein to flow from one location to another. Liquid mercury is used extensively in such electrical switches and sensors as the bridging conducting material.

In a typical switch application, a quantity of liquid mercury, or "mercury melt pool" is positioned inside a capsule or housing into which spaced apart electrodes or electrical contacts extend. Depending on the physical orientation of the housing, the mercury melt pool can provide a conductive pathway between the electrodes, or be positioned such that there is an open circuit between the electrodes. The switch is closed and electrical contact made when the switch housing is moved in a manner such that the mercury melt pool flows toward a location in the housing at which the mercury bridges the spaced electrodes, thereby permitting the flow of electricity from one electrode to the other. Conversely, the switch is opened and electrical contact broken when the switch housing is moved in a manner such that the mercury melt pool flows towards and collects at a different position in the switch housing out of contact with at least one of the electrodes.

An important physical attribute of mercury for the purposes of electrical switch applications, aside from its ability to conduct electricity, is that it remains fluid throughout a wide temperature range thus enabling it to be used in many different environments, or in environments with constantly changing temperature parameters. Another important physical attribute of mercury is that it has significant surface tension and does not wet many surfaces that it contacts, such as glass, metal or polymer surfaces, it shows a high sensitivity to tilting of the switch housing, and it generally does not become damaged by contact with the electrodes.

A problem with mercury-based electrical switches is that mercury is toxic to humans and animals, and exposure to mercury is a significant concern in any application or process in which it is used. Utilization of mercury during manufacturing may present a health hazard to plant personnel, and the disposal of devices that contain mercury switches or the accidental breakage of mercury switches during use may present indirect hazard to people within the immediate vicinity of the switch.

As a result of the toxicity of mercury, non-toxic replacements for mercury in electrical switch applications have been sought. A candidate for replacing mercury in electrical switches is liquid gallium metal or liquid gallium alloys. For example, U.S. Pat. No. 3,462,573 (Rabinowitz et al.) and Japanese Patent Application Sho 57-233016 to Inage et al. each disclose that gallium or gallium alloys may be useful as a replacement for mercury in electrical switches.

However, while gallium is non-toxic, it does not have all of the beneficial properties of mercury. For example, gallium and gallium alloys tend to have a significantly lower density and a lower surface tension than mercury, which may result in inferior contact angles between the gallium or gallium alloy melt pool and the wall of the switch capsule, which is commonly prepared glass. The contact between the gallium or gallium alloy melt pool and the glass of the capsule is generally broader than the contact between a mercury melt pool and glass, resulting in a greater amount of drag acting on the gallium or gallium alloy melt pool. This, coupled with the lower density of the gallium or gallium alloy, means that a switch having gallium or gallium alloy as the bridging conducting material may not be as sensitive to tilt as a comparable mercury based switch.

In view of the drawbacks and problems with the prior art, a need exists for a novel approach to gallium-based electrical switch construction which will reduce or eliminate such drawbacks and problems.

SUMMARY OF THE INVENTION

In some embodiments of the present invention, there is provided an apparatus for making and breaking an electrical connection in an electrical circuit, the apparatus comprising a housing of an electrically non-conducting material, the housing defining a sealed cavity, at least two spaced electrodes, each electrode extending through the housing into the cavity, a contact member within the cavity, the contact member comprised of a core member having a layer of liquid gallium or liquid gallium alloy surrounding the core member wherein the layer of gallium or gallium alloy adheres to the core member, the contact member being moveable within the cavity of the housing in response to movement of the housing to electrically connect any two electrodes by positioning the gallium or gallium alloy layer in contact the two electrodes, and to electrically disconnect the two electrodes by positioning the gallium or gallium alloy layer out of contact with any one of the electrodes.

In some embodiments, the core member may be copper or a copper-coated material. In some embodiments, the gallium alloy may be an alloy of gallium, indium and tin, for example and alloy comprised of gallium in the range of approximately 60–75% of the alloy by weight, indium in the range of approximately 15–30% by weight, and tin in the range of approximately 1–16% by weight. In further example, the gallium alloy may be a eutectic alloy of 62.5% gallium, 21.5% indium, and 16% tin.

In some embodiments, the switch housing may be under vacuum, or may contain an inert atmosphere, such as a noble gas to prevent the oxidation of the gallium.

In some embodiments, the switch housing may contain a fluid containing $NH_3$, for example an aqueous solution of $NH_4OH$ or gaseous mixture.

In some embodiments, there is provided an electrical switch comprising a housing of an electrically non-conducting material, the housing defining a sealed cavity, at least two spaced electrodes, each electrode extending through the housing into the cavity, a contact member within the cavity, the contact member comprising a core member of density greater than 6 g/cm$^3$ and a layer of liquid gallium alloy surrounding and wetted to the core member to pull the gallium alloy meniscus away from the housing, the contact member being moveable within the cavity of the housing in response to gravity to electrically connect any two of said at least two electrodes by positioning the gallium alloy layer in contact with said any two of said at least two electrodes, and to electrically disconnect said any two of said at least two electrodes by positioning the gallium alloy layer out of contact with any one of the two electrodes. In some embodiments, the core member may have a density greater than 9 g/cm$^3$.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

The present invention may be further understood from the following detailed description, with reference to the figures in which.

DETAILED DESCRIPTION OF THE INVENTION

Figure 1:
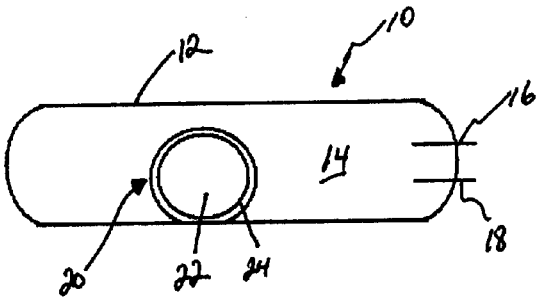
FIG. 1 is a vertical sectional view of the gallium-based electrical switch of FIG. 1 shown in a position where the electrical circuit of the switch is open with the switch is oriented horizontally.

It has been unexpectedly discovered that certain materials, for example some metals, may be wetted by gallium or gallium alloys such that when a small, generally spherical piece of such material, referred to herein as the core member, is placed in an amount of gallium or gallium alloy and treated in accordance with the processes of the present invention, the gallium or gallium alloy wets the surface of the core member and completely surrounds and adheres to the core member to form a "composite ball" (also referred to herein as a "contact member") comprised of the core member and the gallium or gallium alloy that surrounds the core member. It has also been discovered that gallium or gallium alloy, when it is part of a composite ball, exhibits a decreased area of contact with the housing surface than gallium or gallium alloy alone. The forces that cause the gallium or gallium alloy to wet the surface of the core member, and therefore to draw the gallium or gallium alloy around the core member, appear to "peel" the gallium or gallium alloy away from the housing surface, resulting in a relatively smaller contact area between the gallium or gallium alloy and the housing surface. Thus a composite ball of the present invention has a higher sensitivity to tilting of the housing than an equivalent mass of gallium or gallium alloy alone due to the reduced drag on the composite member, which 'rolls' instead of 'drags' on the vial as the vial is tilted. As well, by choosing a core member made of a material having a higher density than gallium, the gravitational driving force acting on the composite ball may be increased as desired, for example, to approximate that of mercury. Furthermore, the amount of gallium or gallium alloy required to form the composite ball is less than the amount required to form a melt pool of a similar size. Thus using a relatively inexpensive material for the core member may result in a savings in the cost of producing the electrical switch.

Either gallium metal itself, or an alloy in which gallium comprises the major elemental constituent, may be used in accordance with the present invention. For example, gallium/indium/tin alloys may have particular potential as a mercury substitute and are commercially available. Typically, the primary component of the gallium/indium/tin alloy is gallium and it constitutes approximately 60–75% of the composition. Indium is generally incorporated in the composition at level of 15–30% and tin is incorporated at a level of 1–16%. In electrical switch applications that require performance at or below the freezing point of water, adding small quantities (less than 5%) of other elements such as lithium, sodium, rubidium, silver, antimony, gold, platinum, cesium and bismuth to the gallium/indium/tin alloy provides a mechanism for depressing the freezing point of the alloy. In some embodiments, a gallium-indium-tin eutectic alloy (62.5% gallium, 21.5% indium, and 16% tin) may be used.

Gallium or gallium alloy has a propensity to become oxidized, and even slight oxidation of gallium may be detrimental to the performance of the switch or sensor because oxidation of the metal reduces the surface tension of the metal in the liquid phase and may lead to wetting of the switch housing, unwanted bridging of the electrodes, sluggish movement of the metal, and poor contact between the metal and the electrodes. As a result, the gallium or gallium alloy used in accordance with the present invention should be substantially, if not completely, oxide free. The oxides may be separated from the gallium or gallium alloy by treatment with an oxide separating agent such as a solution of either hydrazine, formic acid, oxalic acid or ammonium hydroxide, or by hydrazine gas or ammonia gas. The gallium or gallium alloy should thereafter be maintained under a non-oxidizing atmosphere, such as under a vacuum or in an atmosphere of a noble gas.

Tilt response of a melt puddle may be generally described by the equation:

$$mg \cdot \sin\alpha = \gamma W\, f(\theta)$$

where:

m=mass;

g=gravitational constant;

$\alpha$=angle of tilt;

$\gamma$=surface tension;

W=width of the melt puddle in contact with the container; and $\theta$=angle of contact.

The driving force is $mg \cdot \sin\alpha$ and is equal to the friction drag which is proportional to the length of contact of the alloy ball. Gallium alloys generally have a density of about 6 gm/cm$^3$ as compared to the density of mercury of 13.55 gm/cm$^3$. Since gallium alloys tend to have about half the density of mercury, a similar length of gallium alloy ball has half the driving force of a mercury ball, and a switch with gallium would react to about twice the tilt angle than a switch with mercury. Adding more gallium alloy does not increase the tilt response since the length of contact of the alloy ball increases in proportion to the amount of gallium added. In a composite ball configuration, the mass (m) component may be large but the width of the contact area (W) of the gallium alloy is decreased by it being wetted to the core member and being lifted away from the container wall, thus the tilt response of a composite ball is improved over that of gallium or gallium alloy alone. As well, by using a relatively high density material as the core member, the mass (m) of the composite ball may be increased thus resulting in an even greater tilt response of such composite ball over one containing a core member of less dense material. Some of the relatively higher density elements that may be used as core members, or as part of core members, are shown in Table 1 as long as the general requirements of the core member material are met: the surface of the core member should be completely wetted by the gallium or gallium alloy so that the gallium or gallium alloy completely surrounds and engulfs the core member, the surface of the core member should not react with the gallium or gallium alloy, and the core member material should be non-toxic since toxicity is one of the problems with mercury based switches which the present invention seeks to overcome. As well, an element in Table 1 having a desired density but which is not readily wetted by gallium may still be used if it is plated or otherwise covered with another element that is readily wetted by gallium.

TABLE 1

Possible candidates for core member material.

| Element | Density ($g/cm^3$) | Melting point ° F. | Comments |
|---|---|---|---|
| Copper | 8.96 | 1981 | good wetting with Ga |
| Niobium | 8.57 | 4300 | Wetting with Ga difficult |
| Molybdenum | 10.2 | 4760 | Wetting with Ga difficult |
| Silver | 10.49 | 1761 | More expensive than Ga |
| Lead | 11.34 | 621.3 | Toxic |
| Hafnium | 11.4 | 4051 | Wetting with Ga difficult, Rare |
| Thorium | 11.5 | 3300 | Radioactive |
| Thallium | 11.85 | 572 | Wetting with Ga difficult |
| Palladium | 12 | 2829 | Expensive |
| Ruthinum | 12.2 | 4500 | Expensive |
| Rhodium | 12.4 | 3571 | Expensive |
| Tantalum | 16.6 | 5425 | Wetting with Ga difficult |
| Tungsten | 19.3 | 6170 | Wetting with Ga difficult |
| Gold | 19.3 | 1945 | Expensive |
| Rhenium | 20 | 5740 | Expensive |
| Platinum | 21.45 | 3224 | Expensive |
| Iridium | 22.5 | 4449 | Expensive |

The electrical arcing in switches having a composite ball as the conducting material is between the gallium or gallium alloy layer, which is self healing due to its surface tension, and the electrode. The high boiling point of gallium or gallium alloys, which are generally higher than 2000° C., results in low vapor pressure at contact arc and prevents evaporation of the gallium alloy within the glass vial. During arcing, the core member is not pitted due to the protective coating of the gallium or gallium alloy.

In some embodiments, the core member may be copper.

EXAMPLE 1

A solid copper slug having a 4mm diameter was placed into a glass vial containing $NH_4OH$ solution sufficient to immerse the ball approximately 10 cc and approximately 1 gram quantity of a gallium-indium-tin (Ga—In—Sn) eutectic alloy. The temperature of the system was room temperature (approximately 20° C.). The gallium alloy was observed to wet the copper slug and completely surrounded it within two minutes of placement of the slug into the vial to form a composite ball. The wetting action of the gallium alloy onto the copper slug peeled the gallium alloy off the surface of the glass vial thus reducing the contact area between the glass vial and the gallium alloy. The composite ball was observed to have a relatively high sensitivity to tilting of the glass vial.

In addition to using a core member composed entirely of copper, other substances which are not readily wetted by gallium may be used, such as for example other metals listed in table 1 above, upon which a layer of copper may be plated or otherwise coated. The gallium or gallium alloy would be taken up by the wetting action of the gallium to the copper outer layer. For example, a copper coated tantalum ball may be used as a core member, whereas tantalum on its own is not readily wetted by gallium. Tantalum has a density slightly higher than mercury, hence a person skilled in the art may be able to approximate the response characteristics of mercury by using a copper coated tantalum slug or ball as a core member. In general, composite balls displaying a wide variety of response characteristics may be produced by choosing a material with the desired density characteristics as the inner core of a core member upon which a layer of copper may be coated.

Iron was found not to be wetted by gallium, but (as described above) gallium was found to wet copper quite readily. However, copper generally does not bond well to iron or steel unless heat treated at relatively high temperatures. A nickel strike on a steel ball prior to copper plating (for example, by barrel plating) solves the above problem of bonding the copper layer to the steel ball. Therefor, in some embodiments, a steel ball having a copper layer bonded to it as aforementioned may be used as a core member in producing a composite ball with gallium or gallium alloy.

EXAMPLE 2

A core member comprised of a copper coated steel ball weighing 1.1 grams was placed into a glass vial containing $NH_4OH$ solution and a quantity of a gallium-indium-tin (Ga—In—Sn) eutectic alloy weighing 0.2 grams. The temperature of the system was room temperature. The gallium alloy wetted the copper coated steel ball and completely surrounded it to form a composite ball within three minutes of placement of the ball into the vial. The composite ball was observed to have a relatively high sensitivity to tilting of the glass vial.

It was observed that, because of intermetallics between gallium and copper, the copper layer was not consumed by the gallium at room temperature, and a liquid gallium alloy layer was maintained surrounding the copper coated steel ball. The gallium alloy layer near the top of the ball was found to be thinner than near the bottom of the ball due to gravitational flow, but the contact area of the gallium alloy and the glass vial was nevertheless observed to be smaller than for gallium alloy alone because of the wetting action between the gallium and the copper interface. The gallium alloy's meniscus was pulled up by the copper coated steel ball thus limiting the contact of the gallium alloy with the glass surface and reducing the frictional drag component of the tilt response equation.

In some embodiments, the core member may be tungsten carbide (WC) having cobalt (Co) bonded to its outer surface.

EXAMPLE 3

A tungsten carbide ball having cobalt bonded to its outer surface (referred to herein as a WC—Co core member) was immersed in gallium alloy in a crucible. The material was heated to 800° C. for approximately one hour and then cooled. The gallium melt wetted the surface of this WC—Co core member. The WC—Co core member having the thin layer of gallium on it was then removed from the crucible and immersed in a $NH_4OH$ solution in a vial. Three drops of the Ga—In—Sn eutectic alloy were added to the vial. The Ga—In—Sn alloy was immediately taken up by the gallium-wetted WC—Co core member, resulting in a composite ball that moved freely in response to tilting of the vial. It was observed that the Ga—In—Sn alloy coating near the top of the composite ball was thinner than near the bottom of the composite ball. The wetting action of the gallium to the cobalt bonded tungsten carbide ball is not as strong as the wetting action of gallium to copper, thus the WC—Co system results in a composite ball having a larger contact surface between the gallium alloy and the housing relative to the copper-gallium composite ball system, hence resulting in a composite ball having a tilt response intermediate to that of gallium or gallium alloy alone and the cooper-gallium composite ball described above. In some applications, an intermediate tilt response as provided by the WC—Co system may be desirable to the person practicing the present invention. A copper layer may be plated on the WC—Co alloy and the Ga—In—Sn alloy immersion process will provide a WC—Co ball with optimum coating of Ga—In—Sn alloy, with superior tilt response.

It was also observed that shaking of the vial containing a composite ball in a $NH_4OH$ solution appeared to have incorporated oxygen into the solution which appeared to have oxidized the gallium and change its wetting behaviour. The gallium alloy appeared to flow downward on the composite ball resulting in more flattened profile which increased the contact area of the gallium alloy on the glass vial. This effect was observed to be more pronounced with poorly wetted WC—Co core member than with a Cu or Cu-coated core member. To prevent such oxidation within a switch housing, the switch housing may be provided with an inert atmosphere, such as a noble gas, or it may be a vacuum.

In other embodiments of the present invention, a core member may be used to carry a very thin layer of gallium or gallium alloy on it as a coating. This thin coating is able to carry the electrical arc when coming into contact with the electrodes. The thin gallium coating may yield a composite ball with a relatively higher response characteristic by reducing the contact area of the gallium coating for the particular weight of the core member used relative to a composite ball of similar weight having a thicker layer of gallium wetted (and being carried) by the core member. The thin layer of gallium alloy makes minimal contact with the glass housing due to its strong wetting with the underlying copper surface. As well, in temperatures that would cause the gallium alloy to freeze, the thinness of the gallium layer does not result in the formation of protrusions which would otherwise tend occur as a result of the expansion of gallium during freezing. Consequently, such a composite ball would remain mobile even if the thin surface layer of gallium is frozen. The thin solid gallium layer may retain its ability to close an electrical gap between two or more electrodes, hence extending the operable temperature range of a gallium-based switch, without need for a special alloy with compositions to reduce the melting point.

Figure 2:
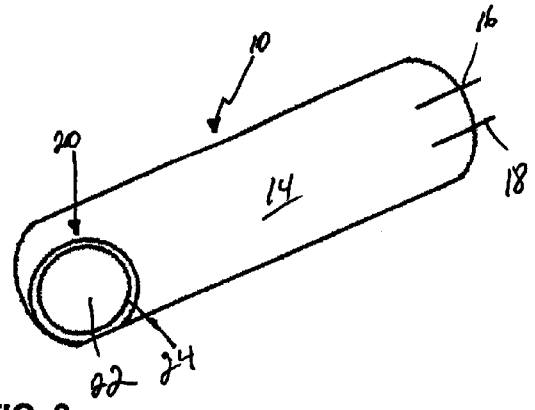
FIG. 2 is a vertical sectional view of a gallium-based electrical switch in accordance with an embodiment of the present invention shown in a position where the electrical circuit of the switch is open.
Figure 3:
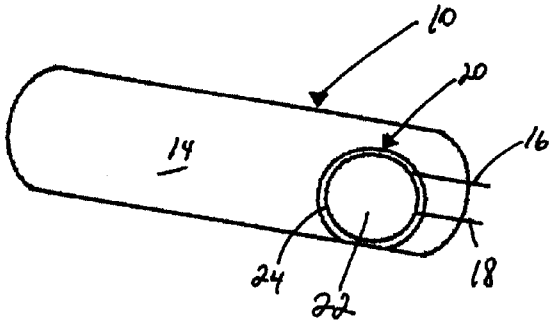
FIG. 3 is a vertical sectional view of the gallium-based electrical switch of FIGS. 1 and 2 shown in a position where the electrical circuit of the switch is closed.

Referring to FIGS. 1, 2 and 3, there is illustrated an electrical switch in accordance with an embodiment of the present invention. In FIG. 1, the electrical switch 10 is shown in a position wherein the electrical circuit through the switch is open. Electrical switch 10 is comprised of ampoule or housing 12 that defines cavity 14. Housing 10 is usually made out of glass, but may be made out of any other suitable non-electrically conductive material as would be apparent to a person skilled in the art. At least two spaced electrodes 16 and 18 are provided such that each electrode extends through the housing 12 into the cavity 14 so as to be able to conduct electricity from the cavity 14 to outside of the housing. It will be understood that more than two electrodes may be used and there may be many possible configurations of electrodes to provide the desired electrical switching action which are within the scope of the present invention. Within the cavity 14 is a composite ball 20 which is comprised of a core member 22 and a layer of gallium or gallium alloy 24 that is wefted to, and surround, the surface of the core member. Core member 22 may be comprised of material as described hereinbefore.

In FIGS. 1 and 2, electrical switch 10 is physically oriented in a manner such that the gallium or gallium alloy 24 does not bridge electrodes 16 and 18 such that an electric current may not flow between the electrodes.

In FIG. 1, switch 10 is shown in a generally horizontal position with the composite ball 20 being in a position part way toward the electrodes 16 and 18.

Referring to FIG. 3, the electrical switch 10 is shown in a position wherein the electrical circuit through the switch is closed. The switch 10 is physically oriented such that gallium or gallium alloy 24 on core member 22 bridges the spaced electrodes 16 and 18 as shown thereby connecting the electrodes electrically.

While specific embodiments of the invention have been described and illustrated, such embodiments should be considered illustrative of the invention only and not as limiting the invention as construed in accordance with the accompanying claims.

What is claimed is:

1. An apparatus for making and breaking an electrical connection in an electrical circuit, the apparatus comprising:

a) a housing of an electrically non-conducting material, the housing defining a sealed cavity;

b) at least two spaced electrodes, each electrode extending through the housing into the cavity;

c) a contact member within the cavity, the contact member comprising a core member having a layer of liquid gallium alloy surrounding and wetted to the core member to pull the gallium alloy meniscus away from the housing, the contact member being moveable within the cavity of the housing in response to movement of the housing to electrically connect any two of said at least two electrodes by positioning the gallium alloy layer in contact with said any two of said at least two electrodes, and to electrically disconnect said any two of said at least two electrodes by positioning the gallium alloy layer out of contact with any one of said any two of said at least two electrodes.

2. The apparatus of claim 1 wherein the core member has a surface of copper.

3. The apparatus of claim 2 wherein the gallium alloy is an alloy comprised of gallium, indium, and tin.

4. The apparatus of claim 2 wherein the gallium alloy is an alloy comprised of 60–75% gallium, 15–30% indium and 1–16% tin.

5. The apparatus in claim 2 wherein the gallium alloy is an alloy comprised of 62.5% gallium, 21.5% indium and 16% tin.

6. The apparatus in claim 2 further comprising a chemically inert and electrically non-conducting fluid within the cavity.

7. The apparatus in claim 6 wherein the fluid is a noble gas.

8. The apparatus in claim 2 further comprising a fluid containing $NH_3$ within the switch housing.

9. The apparatus in claim 2 further comprising $NH_4OH$ solution within the switch housing.

10. The apparatus in claim 2 wherein the cavity of the housing is under vacuum.

11. An electrical switch comprising:

a) a housing of an electrically non-conducting material, the housing defining a sealed cavity;

b) at least two spaced electrodes, each electrode extending through the housing into the cavity;

c) a contact member within the cavity, the contact member comprising a core member of density greater than 6 $g/cm^3$ and a layer of liquid gallium alloy surrounding and wetted to the core member to pull the gallium alloy meniscus away from the housing, the contact member being moveable within the cavity of the housing in response to gravity to electrically connect any two of said at least two electrodes by positioning the gallium alloy layer in contact with said any two of said at least two electrodes, and to electrically disconnect said any two of said at least two electrodes by positioning the gallium alloy layer out of contact with any one of said any two of said at least two electrodes.

12. The apparatus of claim 11 wherein the core member has a density greater than 9 $g/cm^3$.

13. The apparatus of claim 11 wherein the core member has a surface of copper.

14. The apparatus of claim 13 wherein the gallium alloy is an alloy comprised of gallium, indium, and tin.

15. The apparatus of claim 14 wherein the gallium alloy is an alloy comprised of 60–75% gallium, 15–30% indium and 1–16% tin.

16. The apparatus in claim 13 wherein the gallium alloy is an alloy comprised of 62.5% gallium, 21.5% indium and 16% tin.

17. The apparatus in claim 13 further comprising a chemically inert and electrically non-conducting fluid within the cavity.

18. The apparatus in claim 17 wherein the fluid is a noble gas.

19. The apparatus in claim 13 further comprising a fluid containing $NH_3$ within the switch housing.

20. The apparatus in claim 13 further comprising $NH_4OH$ solution within the switch housing.

* * * * *